US010477939B2

(12) United States Patent
Hwang

(10) Patent No.: US 10,477,939 B2
(45) Date of Patent: Nov. 19, 2019

(54) CUSHION COMPACT CONTAINER

(71) Applicant: F.S. KOREA INDUSTRIES INC., Seoul (KR)

(72) Inventor: Jae Kwang Hwang, Seoul (KR)

(73) Assignee: F.S. KOREA INDUSTRIES INC., Seoul (KR)

( * ) Notice: Subject to any disclaimer, the term of this patent is extended or adjusted under 35 U.S.C. 154(b) by 388 days.

(21) Appl. No.: 15/363,304

(22) Filed: Nov. 29, 2016

(65) Prior Publication Data

US 2017/0188684 A1 Jul. 6, 2017

(30) Foreign Application Priority Data

Dec. 1, 2015 (KR) ..... 10-2015-0170012

(51) Int. Cl.

*A45D 44/18* (2006.01)
*A45D 33/00* (2006.01)
*A45D 34/04* (2006.01)
*A45D 33/36* (2006.01)

(52) U.S. Cl.

CPC ..... *A45D 33/008* (2013.01); *A45D 34/042* (2013.01); *A45D 33/36* (2013.01)

(58) Field of Classification Search

CPC .... A45D 33/00; A45D 33/003; A45D 33/006; A45D 33/008; A45D 33/16; A45D 33/18; A45D 33/22; A45D 33/38; A45D 33/36; A45D 34/042; A45D 2200/109; B65D 25/04

USPC ..... 220/521, 524, 527, 529, 555

See application file for complete search history.

(56) References Cited

U.S. PATENT DOCUMENTS 6,474,346 B1 * 11/2002 Jang ..... A45D 33/02 132/293
2010/0143021 A1 * 6/2010 De Laforcade ..... A45D 33/00 401/129
2011/0048443 A1 * 3/2011 Pires ..... A45D 33/003 132/200
2011/0271978 A1 * 11/2011 Bae ..... A45D 33/006 132/293

FOREIGN PATENT DOCUMENTS

KR 10-1536590 B1 7/2015

* cited by examiner

*Primary Examiner* — Rachel R Steitz

(74) *Attorney, Agent, or Firm* — Heedong Chae; Lucem, PC

(57) ABSTRACT

Disclosed is a cushion compact container. The present invention provides a cushion compact container including: a container main body provided with a container body and a cover openably and closably coupled to the container body; a cosmetic storage unit coupled to the container body and storing a cosmetic; and a cosmetic applicator unit which is coupled to a region of the cover which is opposite to the cosmetic storage unit, and allows a user to apply the cosmetic stored in the cosmetic storage unit so that the user spreads the cosmetic onto the user's face or the like without using hand, in which the cosmetic applicator unit is separated from the container body without opening the cover, and the cosmetic storage unit is coupled to the container body to be detachable downward from the container body in a state in which the cover is coupled to the container body.

7 Claims, 6 Drawing Sheets

CUSHION COMPACT CONTAINER

CROSS-REFERENCE TO RELATED APPLICATION

This application claims the benefit of Korean Application No. 10-2015-0170012 filed on Dec. 1, 2015 with the Korean Intellectual Property Office, the disclosure of which is incorporated herein by reference.

BACKGROUND OF THE INVENTION

1. Field of the Invention

The present invention relates to a compact container, and more particularly, to a cushion compact container capable of improving usability and enabling cosmetics to be conveniently supplemented or changed.

2. Description of the Related Art

In general, compact cases are variously and widely used in accordance with shapes and forms of the compact cases, structures for opening and closing lids, and the like.

Among the compact cases, the compact case, which is most universal and widely known, is configured to have a quadrangular or circular shape, and has therein a pair of accommodating grooves that accommodates makeup tools such as cosmetics, brushes, and puffs.

In addition, the lid of the compact case is generally configured to be opened and closed from a front side to a rear side in a vertical direction based on a hinge as a support point at a rear side of the lid.

However, the general compact case in the related art, which has been known and used up to now, has a structure in which the lid needs to be opened so that the brush may be used. This structure causes inconvenience because the lid needs to be always opened to allow a user to use the brush, and thus, there is a need for a solution for the inconvenience.

In addition, in the case of the existing compact case, a cover needs to be necessarily opened in order to change or supplement the cosmetic, which also causes inconvenience, and thus, there is a need for a solution for the inconvenience.

The aforementioned technology and configuration are the background of the present invention only for helping understand the present invention, and does not mean the related art widely known in the technical field to which the present invention pertains.

RELATED ART DOCUMENT

Patent Document

Korean Patent No. 10-1536590 (Pum-Tech Korea Co., Ltd.) Jul. 8, 2015.

SUMMARY OF THE INVENTION

An object of the present invention is to provide a cushion compact container capable of improving usability and enabling cosmetics to be conveniently supplemented or changed.

According to an aspect of the present invention, a cushion compact container includes: a container main body which is provided with a container body, and a cover openably and closably coupled to the container body; a cosmetic storage unit which is coupled to the container body and stores a cosmetic; and a cosmetic applicator unit which is coupled to a region of the cover which is opposite to the cosmetic storage unit, and allows a user to apply the cosmetic stored in the cosmetic storage unit so that the user spreads the cosmetic onto his/her face or the like without using his/her hand, in which the cosmetic applicator unit is separated from the container body without opening the cover, and the cosmetic storage unit is coupled to the container body so as to be detachable downward from the container body in a state in which the cover is coupled to the container body.

In an embodiment of the present invention, the cosmetic applicator unit may include: a handle body; a cosmetic applicator member which is coupled to the handle body by means of a fixing member, and includes a brush to which the cosmetic is attached; and a collecting unit which is coupled to the handle body so as to be movable upward and downward, and uniformly collects the expanded cosmetic applicator member.

In an embodiment of the present invention, the collecting unit may be provided in a cylindrical shape, and a catching projection, which is caught and supported by an upper end portion of the fixing member, may be provided at an upper end portion of the collecting unit so as to limit a height which the collecting unit moves downward.

In an embodiment of the present invention, a stopper ring, which prevents the collecting unit from being inserted into the handle body, may be provided at a lower end portion of the collecting unit.

In an embodiment of the present invention, the handle body may be fitted and coupled with an accommodating groove provided in the cover, and at least one fixing protrusion may be provided on an outer circumferential surface of the handle body.

In an embodiment of the present invention, the cosmetic storage unit may include: a cosmetic storage body which stores the cosmetic, and is caught by and coupled to a coupling piece provided on the container body; an enlarged portion which is provided on the cosmetic storage body, and seals a space portion provided in the container body; and a releasing flange which is provided on the cosmetic storage body, and releases the cosmetic storage body caught, by and coupled to the coupling piece by applied external force.

In an embodiment of the present invention, an elastic hole may be provided between the releasing flange and the cosmetic storage body.

In an embodiment of the present invention, the cosmetic applicator member may be coupled to the fixing member, the fixing member may be fitted and coupled into an interior of the handle body, and a position of the collecting unit may be fixed as a region except for a stopper ring is disposed between an inner wall of the handle body and the fixing member and a natural downward movement of the collecting unit is restricted by the expanded cosmetic applicator member.

According to the exemplary embodiments of the present invention, since the cosmetic applicator unit is provided on the cover, the cosmetic applicator unit may be separated from the container body without opening the cover, and since the cosmetic storage unit is coupled to the container body so as to be detachable downward from the container body in a state in which the cover is coupled to the container body, it is possible to improve usability and to conveniently supplement or change the cosmetic.

DETAILED DESCRIPTION OF THE PREFERRED EMBODIMENT

Figure 1:
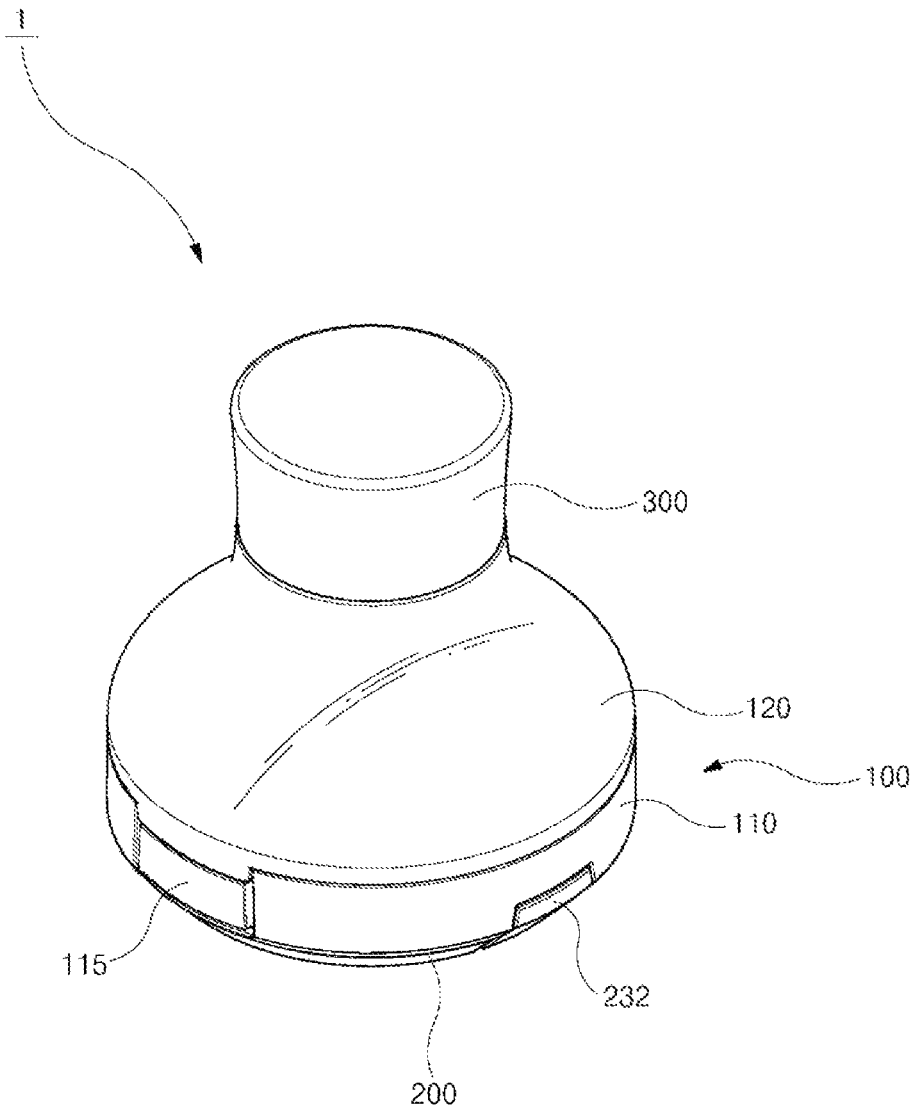
FIG. 1 is a perspective view schematically illustrating a cushion compact container according to an exemplary embodiment of the present invention.

In order to sufficiently understand the object that will be achieved by the present invention, advantages in operation of the present invention, and implementation of the present invention, reference needs to be made to the accompanying drawings for illustrating an exemplary embodiment of the present invention and contents disclosed in the accompanying drawings.

Hereinafter, an exemplary embodiment of the present invention will be described in detail with reference to the accompanying drawings. Like reference numerals indicated in the respective drawings refer to the same constituent elements.

Figure 2:
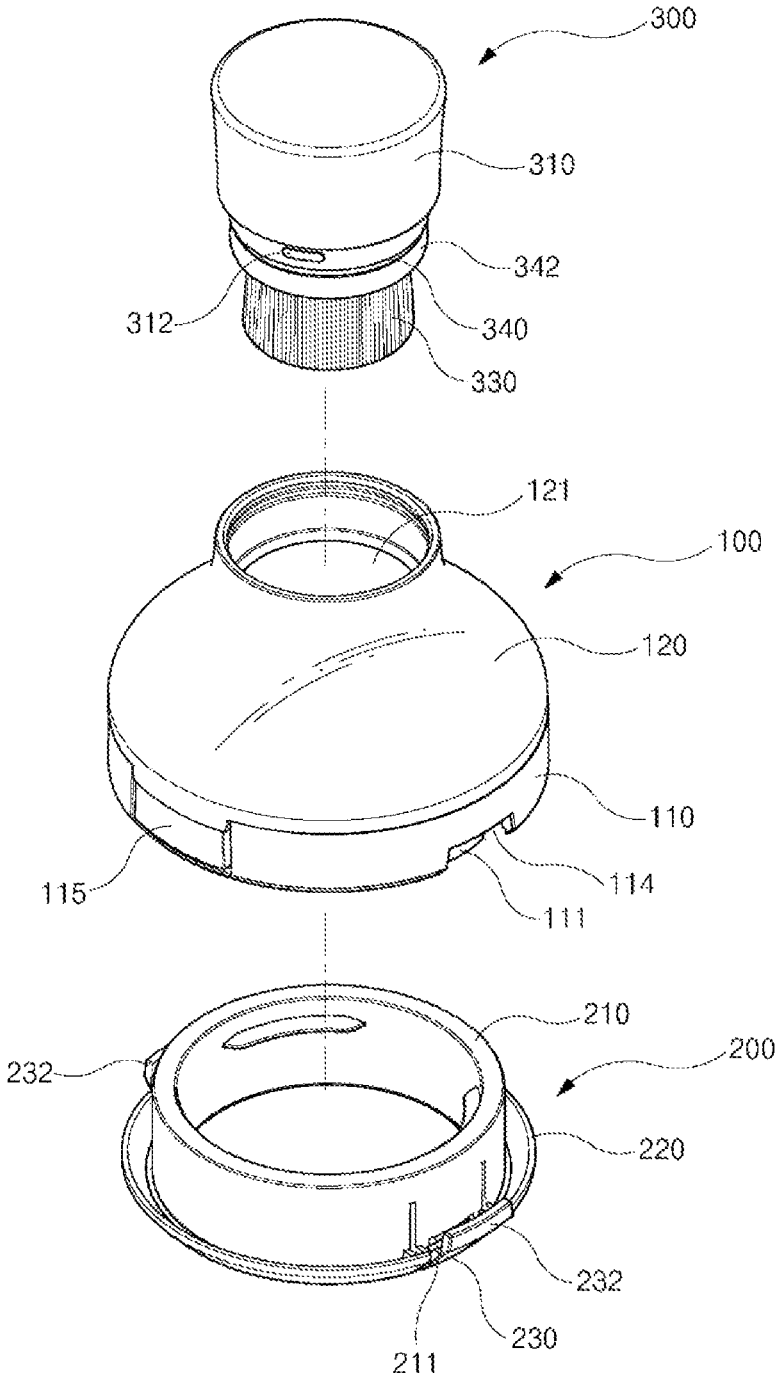
FIG. 2 is an exploded perspective view of FIG. 1.
Figure 3:
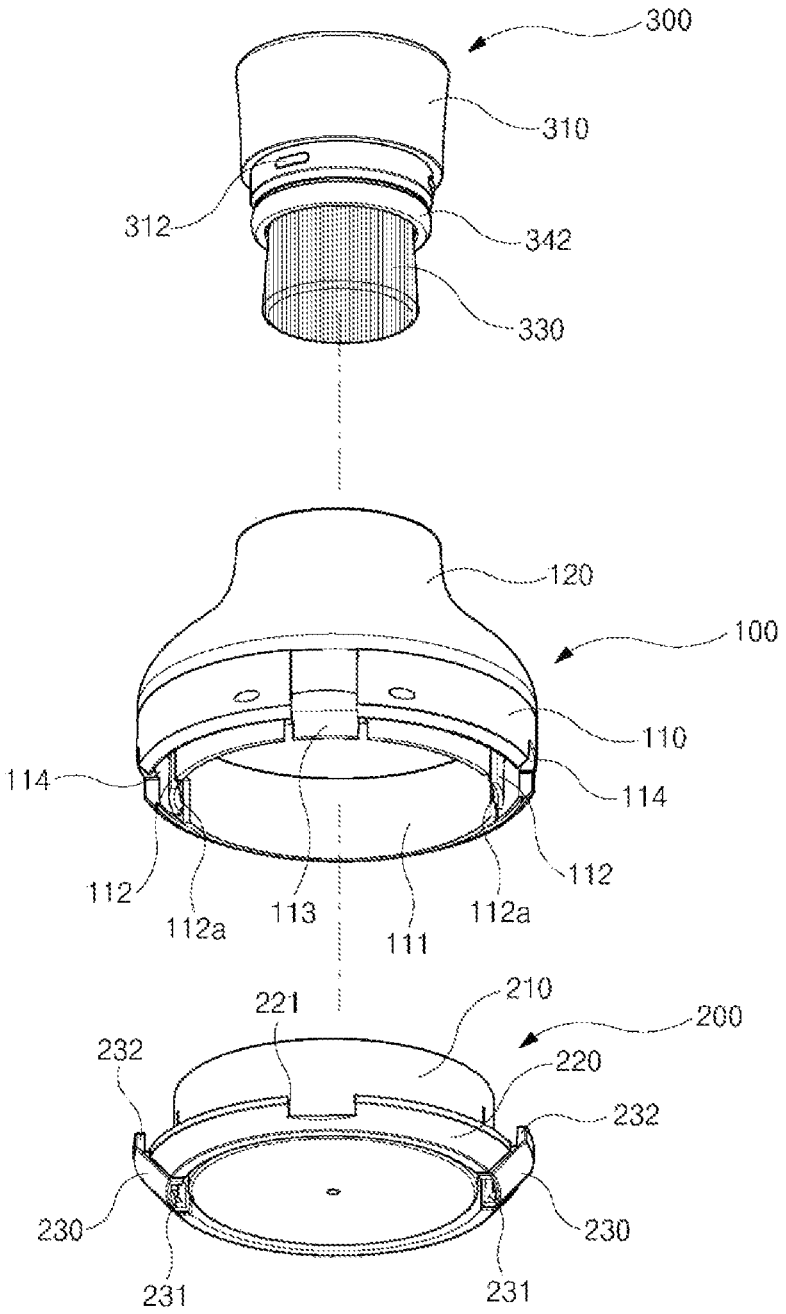
FIG. 3 is an exploded bottom perspective view of FIG. 2.
Figure 4:
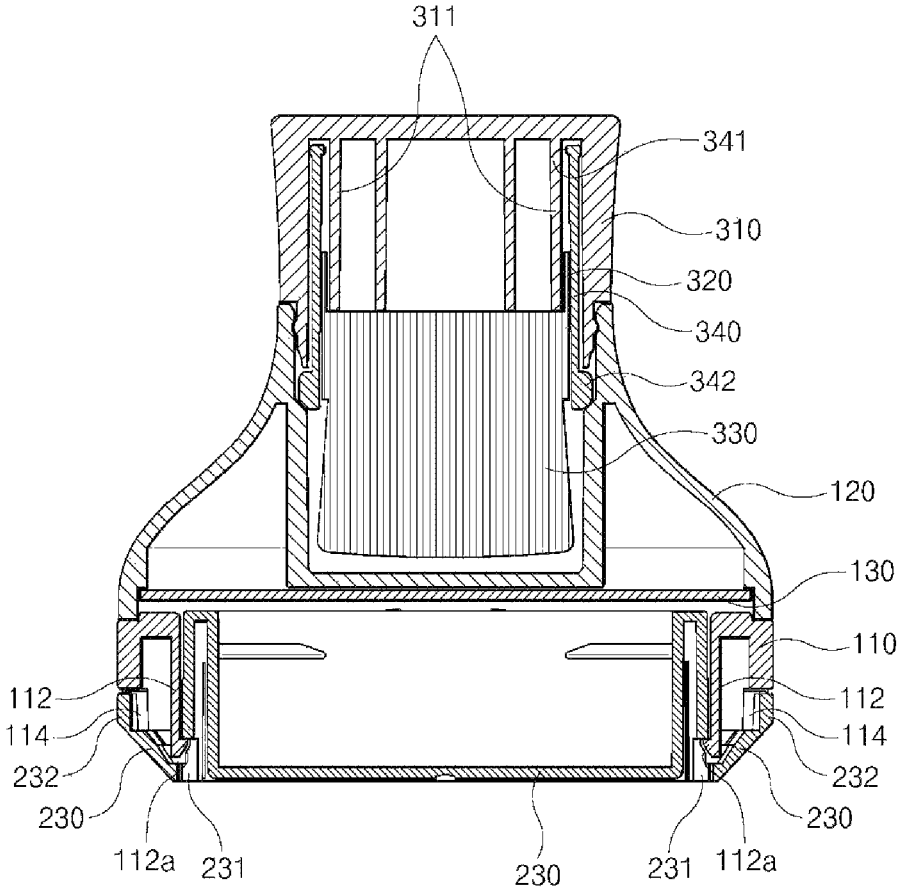
FIG. 4 is a cross-sectional view of FIG. 1.
Figure 5:
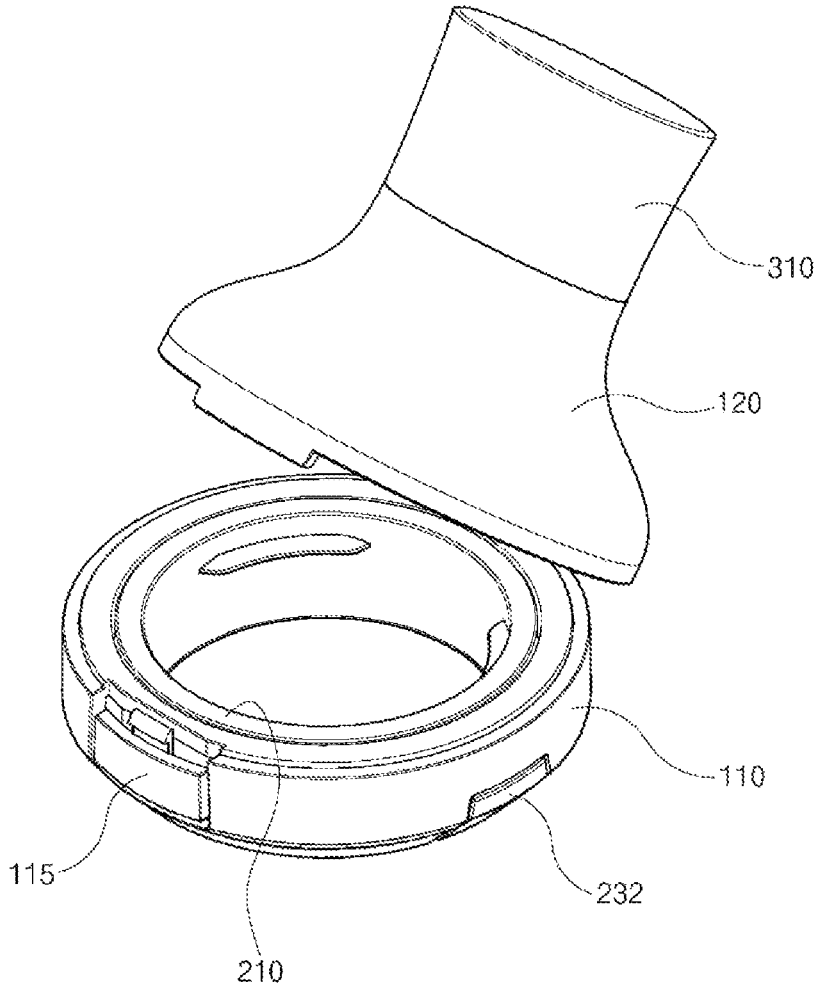
FIG. 5 is a perspective view illustrating a state in which a cover of a container body illustrated in FIG. 1 is opened.

FIG. 1 is a perspective view schematically illustrating a cushion compact container according to an exemplary embodiment of the present invention, FIG. 2 is an exploded perspective view of FIG. 1, FIG. 3 is an exploded bottom perspective view of FIG. 2, FIG. 4 is a cross-sectional view of FIG. 1, FIG. 5 is a perspective view illustrating a state in which a cover of a container body illustrated in FIG. 1 is opened, and FIG. 6 is a view illustrating an operation of a cosmetic applicator unit illustrated in FIG. 2.

As illustrated in the drawings, a cushion compact container 1 according to the present exemplary embodiment includes a container main body 100, a cosmetic storage unit 200 which is coupled to the container main body 100 and stores a cosmetic, and a cosmetic applicator unit 300 which is coupled to a region of a cover 120 which is opposite to the cosmetic storage unit 200 and allows a user to apply the cosmetic stored in the cosmetic storage unit 200 so that the user may spread the cosmetic onto his/her face or the like without using his/her hand.

As illustrated in FIG. 5, the container main body 100 includes a container body 110, the cover 120 which is openably and closably coupled to the container body 110, and a mirror 130 which is coupled to the cover 120 by means of an attaching member including an adhesive.

As illustrated in FIG. 5, the container body 110 of the container main body 100 may be provided in a circular shape, and in the present exemplary embodiment, the container body 110 has a hole except for an edge thereof. As illustrated in FIG. 5, a cosmetic storage body 210 is coupled to the hole, and the cosmetic storage body 210 may be separated downward from the container body 110.

As illustrated in FIG. 3, in the present exemplary embodiment, the container body 110 includes an inner wall portion 111 which is spaced apart from an outer wall of the container body 110, coupling pieces 112 which are formed by cutting out a part of the inner wall portion 111 and have coupling protrusions 112*a* at end portions thereof so as to catch and support the cosmetic storage unit 200, a position guide piece 113 which is disposed between the pair of coupling pieces 112 and formed by cutting out the inner wall portion 111 so as to guide a coupling position of the container body 110, coupling grooves 114 which are provided at inner wall lower end portions of the container body 110 and provide accommodating locations for releasing pieces 232, and an opening and closing button 115 which is provided on the container body 110 and opens and closes the cover 120 in a catching and supporting manner.

In the present exemplary embodiment, since the coupling pieces 112 and the position guide piece 113 are formed by cutting out the inner wall portion 111, the coupling pieces 112 and the position guide piece 113 may be spread or retracted in a direction toward a central portion of the container body 110 and in the opposite direction thereto.

As a result, the inner wall portion 111 may press an outer circumferential surface of the cosmetic storage body 210 when the cosmetic storage body 210 is inserted and lower end portions of the coupling pieces 112 are also spread outward and caught and supported by catching grooves 211 of the cosmetic storage body 210.

As illustrated in FIG. 2, an accommodating groove 121 is provided in the cover 120 of the container main body 100, a handle body 310 of the cosmetic applicator unit 300 is coupled to the accommodating groove 121 in a fitting manner, and a cosmetic applicator member 330 is accommodated in the accommodating groove 121.

In the present exemplary embodiment, since the cosmetic applicator unit 300 is separably coupled to the cover 120 instead of the container body 110, it is possible to eliminate the inconvenience of having to open the cover 120 when using the cosmetic applicator unit 300.

The cosmetic storage unit 200 stores cosmetics including liquid-phase foundation, powder, and the like, and as illustrated in FIGS. 2 and 3, the cosmetic storage unit 200 may be coupled to the container body 110 so as to be separable downward from the container body 110.

As illustrated in FIG. 2, in the present exemplary embodiment, the cosmetic storage unit 200 includes the cosmetic storage body 210 which has a circular shape corresponding to the shape of the inner wall portion 111 and stores therein the cosmetic, an enlarged portion 220 which is provided on the cosmetic storage body 210 and seals a space portion provided in the container body 110, and releasing flanges 230 which are provided on the cosmetic storage body 210 and release the cosmetic storage body 210 caught by and coupled to the coupling pieces 112 by applied external force.

As illustrated in FIGS. 2 and 3, since the cosmetic storage body 210 of the cosmetic storage unit 200 may be separated downward from the container body 110, it is possible to conveniently separate the cosmetic storage body 210 without opening the cover 120 when changing or supplementing the cosmetic in the cosmetic storage body 210.

In addition, since the cosmetic storage body 210 may be separated in a case in which it is necessary to clean an interior of the cosmetic storage body 210 when the stored cosmetic is changed, it is possible to clearly clean the cosmetic storage body 210.

As illustrated in FIG. 2, the enlarged portion 220 of the cosmetic storage body 210 is provided at a lower side of the cosmetic storage body 210 so as to be greater than an outer diameter of the cosmetic storage body 210. In addition, in the present exemplary embodiment, as illustrated in FIG. 3, the enlarged portion 220 may be formed to be inclined so that a diameter of the enlarged portion 220 is increased in a direction from the lower end portion toward an upper side thereof, such that the enlarged portion 220 seals the space portion between the inner wall portion 111 and the outer wall of the container body 110.

As illustrated in FIG. 3, in the present exemplary embodiment, the enlarged portion 220 may be provided to be spaced apart from the cosmetic storage body 210.

In addition, as illustrated in FIG. 3, in the present exemplary embodiment, a position guide cut-out groove 221 may be provided in the enlarged portion 220, and the position guide cut-out groove 221 may be provided on a straight line with the region of the container body 110 where the cover 120 is rotatably coupled. That is, as illustrated in FIG. 3, the position guide cut-out groove 221 may be provided between the pair of releasing flanges 230.

As illustrated in FIGS. 2 and 3, the releasing flanges 230 of the cosmetic storage unit 200 are provided at the lower end portion of the cosmetic storage body 210, and as illustrated in FIG. 3, upper portions of the releasing flanges 230 may become close to or far away from the outer wall of the cosmetic storage body 210 by elastic holes 231 provided at lower sides of the releasing flanges 230. As a result, when the user applies external force to the releasing flanges 230, the releasing flanges 230 move close to the outer wall of the cosmetic storage body 210, and the caught state by the coupling pieces 112 is released, and as a result, the cosmetic storage unit 200 may be separated from the container body 110.

In the present exemplary embodiment, as illustrated in FIG. 3, releasing pieces 232 having a flat shape may be provided on upper end portions of the releasing flanges 230, respectively, so as to move the releasing flanges 230 close to the outer wall of the cosmetic storage body 210 with a small effort.

As illustrated in FIGS. 1 and 2, the cosmetic applicator unit 300 is coupled to the cover 120 and serves to apply the cosmetic so that the user may spread the cosmetic onto his/her face or the like without touching the cosmetic with his/her hand.

As illustrated in FIG. 4, in the present exemplary embodiment, the cosmetic applicator unit 300 includes the handle body 310 which has therein fixing posts 311, a circular fixing member 320 which is coupled to the fixing posts 311 having a vacant interior in a fitting manner, the cosmetic applicator member 330 which is coupled to the fixing member 320, and includes a brush to which the cosmetic is attached, and a collecting unit 340 which is provided between the handle body 310 and the fixing member 320, and moved upward and downward in a height direction of the handle body 310 so as to collect the cosmetic applicator member 330 so that the cosmetic applicator member 330 has the same diameter.

The handle body 310 of the cosmetic applicator unit 300 is detachably fitted and coupled with the accommodating groove 121 of the cover 120 illustrated in FIG. 2.

In the present exemplary embodiment, as illustrated in FIG. 3, a plurality of fixing protrusions 312 is provided on an outer circumferential surface of the handle body 310, and the plurality of fixing protrusions 312 serves to provide frictional force to an inner wall of the accommodating groove 121 so that the handle body 310 is not easily separated from the accommodating groove 121.

The cosmetic applicator member 330 of the cosmetic applicator unit 300 may include a brush, a sponge, an applicator, and the like for applying the cosmetic including liquid-phase foundation, power, and the like, and the cosmetic applicator member 330 may be attached to the fixing member 320 by using an adhesive or the like.

As illustrated in FIG. 4, the collecting unit 340 of the cosmetic applicator unit 300 is provided between the fixing member 320 and the handle body 310, arid moved upward and downward in the height direction of the handle body 310 by external force by the user, such that a lower portion of the collecting unit 340 collects the expanded cosmetic applicator member 330, thereby allowing the cosmetic applicator member 330 to be easily accommodated in the accommodating groove 121 of the cover 120.

In the present exemplary embodiment, the collecting unit 340 may be provided in a cylindrical shape, a catching projection 341, which is caught and supported by an upper end portion of the fixing member 320, is provided at an upper end portion of the collecting unit 340, and a stopper ring 342, which prevents the collecting unit 340 from being inserted into the handle body 310, is provided at a lower end portion of the collecting unit 340.

Hereinafter, an operation of the collecting unit 340 will be briefly described with reference to FIG. 6.

Figure 6A:
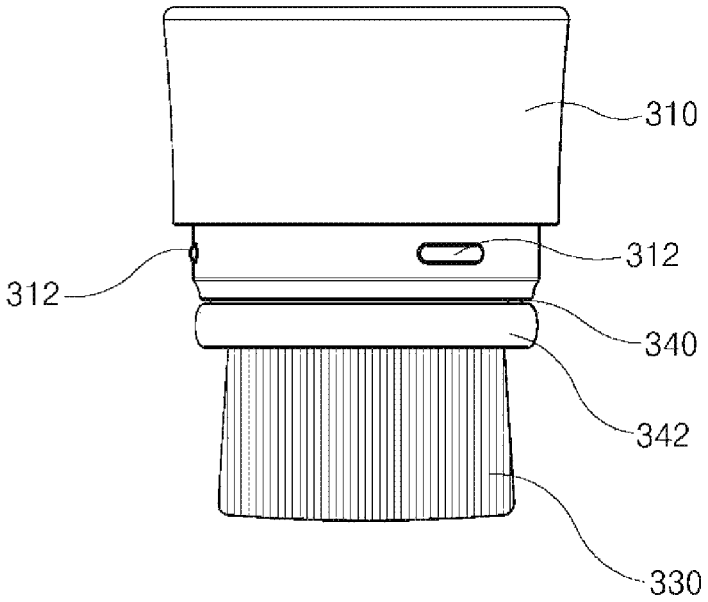
FIG. 6 is a view illustrating an operation of a cosmetic applicator unit illustrated in FIG. 2.

First, as illustrated in FIG. 6A, when the stopper ring 342 is disposed close to the lower end portion of the handle body 310, the cosmetic applicator member 330 such as a brush has a horizontal area that increases downward.

Figure 6B:
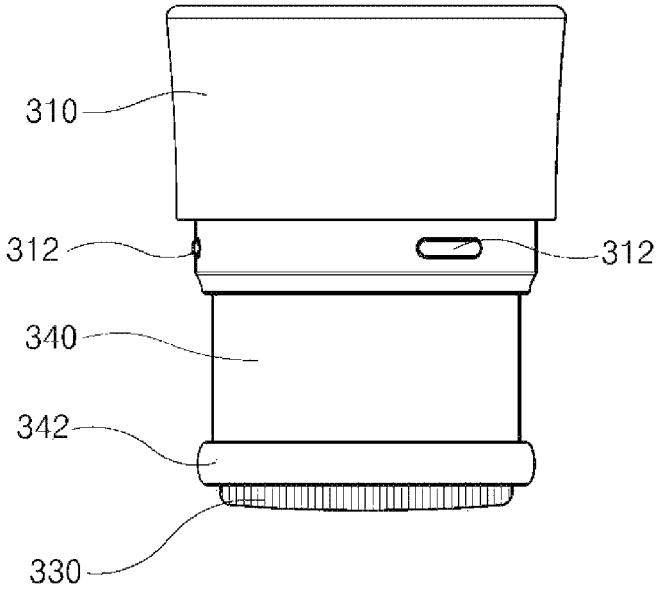

In this state, as illustrated in FIG. 6B, when the collecting unit 340 is moved downward, the collecting unit 340 collects the cosmetic applicator member 330 such as a brush having an expanded lower end portion so that the lower end portion has the same area as the upper end portion.

As a result, it is possible to eliminate interference caused by the cosmetic applicator member 330 when the cosmetic applicator unit 300 is coupled to the accommodating groove 121 of the cover 120, and as a result, it is possible to conveniently couple the cosmetic applicator unit 300 to the accommodating groove 121.

Further, in the present exemplary embodiment, a lid (not illustrated) is provided on the cosmetic storage body 210, so that the cosmetic storage body 210 may be used as a refillable product.

As described above, in the present exemplary embodiment, since the cosmetic applicator unit is provided on the cover, the cosmetic applicator unit may be separated from the container body without opening the cover, and since the cosmetic storage unit is coupled to the container body so as to be detachable downward from the container body in a state in which the cover is coupled to the container body, it is possible to improve usability and to conveniently supplement or change the cosmetic.

It is obvious to those skilled in the art that the present invention is not limited to the aforementioned exemplary embodiments, and may be variously changed and modified without departing from the spirit and the scope of the present invention. Therefore, the changed or modified exemplary embodiments are included in the claims of the present invention.

What is claimed is:

1. A cushion compact container comprising:

a container main body which is provided with a container body and a cover openably and closably coupled to the container body;

a cosmetic storage unit which is coupled to the container body and stores a cosmetic; and a cosmetic applicator unit which is coupled to a region of the cover which is opposite to the cosmetic storage unit, and allows a user to apply the cosmetic stored in the cosmetic storage unit so that the user spreads the cosmetic onto the user's face without using the user's hand, wherein the cosmetic applicator unit is separated from the container body without opening the cover, and the cosmetic storage unit is coupled to the container body so as to be detachable downward from the container body in a state in which the cover is coupled to the container body, wherein the cosmetic applicator unit includes:

a handle body that is fitted and coupled with an accommodating groove provided in the cover;

a cosmetic applicator member that is coupled to the handle body by means of a fixing member, and the cosmetic applicator member includes a brush to which the cosmetic is attached; and a collecting unit which is coupled to the handle body so as to be movable upward and downward, and uniformly collects the expanded cosmetic applicator member, wherein a stopper ring is provided at a lower end portion of the collecting unit, wherein the collecting unit moves downwardly to a lower portion of the cosmetic applicator member such that the collecting unit collects the cosmetic applicator member and, when the cosmetic applicator unit is coupled to the accommodating groove of the cover, the stopper ring is caught by an annular rim provided within the cover and the collecting unit is raised, and wherein the collecting unit is disposed between the handle body and the fixing member such that the collecting unit is movable upward and downward within the handle body.

2. The cushion compact container of claim 1, wherein the collecting unit is provided in a cylindrical shape, and a catching projection, which is caught and supported by an upper end portion of the fixing member, is provided at an upper end portion of the collecting unit so as to limit a height which the collecting unit moves downward.

3. The cushion compact container of claim 2, wherein the stopper ring prevents the collecting unit from being inserted into the handle body.

4. The cushion compact container of claim 1, wherein at least one fixing protrusion is provided on an outer circumferential surface of the handle body.

5. The cushion compact container of claim 1, wherein the cosmetic storage unit includes:

a cosmetic storage body which stores the cosmetic, and is caught by and coupled to a coupling piece provided on the container body;

an enlarged portion which is provided on the cosmetic storage body, and seals a space portion provided in the container body; and a releasing flange which is provided on the cosmetic storage body, and releases the cosmetic storage body caught by and coupled to the coupling piece by applied external force.

6. The cushion compact container of claim 5, wherein an elastic hole is provided between the releasing flange and the cosmetic storage body.

7. The cushion compact container of claim 1, wherein the cosmetic applicator member is coupled to the fixing member, the fixing member is fitted and coupled into an interior of the handle body, and a position of the collecting unit is fixed as a region except for a stopper ring is disposed between an inner wall of the handle body and the fixing member and a natural downward movement of the collecting unit is restricted by the expanded cosmetic applicator member.

* * * * *